United States Patent [19]

England

[11] 3,997,926

[45] Dec. 21, 1976

[54] BED WITH AUTOMATIC TILTING OCCUPANT SUPPORT

[76] Inventor: Robert W. England, Rte. 3, Box 356, Cheney, Wash. 99041

[22] Filed: July 9, 1975

[21] Appl. No.: 594,346

[52] U.S. Cl. ..... 5/62; 5/81 R

[51] Int. Cl.[2] ..... A61G 7/10

[58] Field of Search ..... 5/60–63, 5/81, 86; 269/323 X

[56] References Cited

UNITED STATES PATENTS

| | | | |
|---|---|---|---|
| 1,557,662 | 10/1925 | Grawford | 5/62 |
| 2,905,952 | 9/1959 | Reichert et al. | 5/81 |
| 2,913,738 | 11/1959 | Wise | 5/60 |
| 3,640,520 | 2/1972 | Wieland et al. | 5/62 |
| 3,644,944 | 2/1972 | Bourgraf et al. | 5/62 |
| 3,797,050 | 3/1974 | Benoit et al. | 5/62 |

*Primary Examiner*—Casmir A. Nunberg
*Attorney, Agent, or Firm*—Wells, St. John & Roberts

[57] ABSTRACT

A bed including an open supportive framework pivotably mounting an occupant support platform for movement between a horizontal and an upright position. The bed includes a drive mechanism and associated motor with controls to enable selective movement of the platform between the two positions. The drive assembly includes a lead screw operatively connecting the open framework to the platform. A nut pivotably mounted on the framework threadably receives the screw which, when turned, causes pivotal movement of the platform between the two positions. The framework is open at a foot end of the bed to enable an occupant to move freely toward or away from the support platform. The platform includes a foot rest assembly that may be selectively moved longitudinally relative to the platform between an operative and inoperative position. In the operative position, the foot rest may be utilized to receive and support the weight of the occupant. The inoperative position of the foot rest assembly allows free movement of the occupant's feet. Safety provisions assure that the platform cannot be pivoted past either position, that the platform cannot fall during a power outage, and that the motor will not operate unless the foot rest is in the operative position.

8 Claims, 10 Drawing Figures

FIG 2
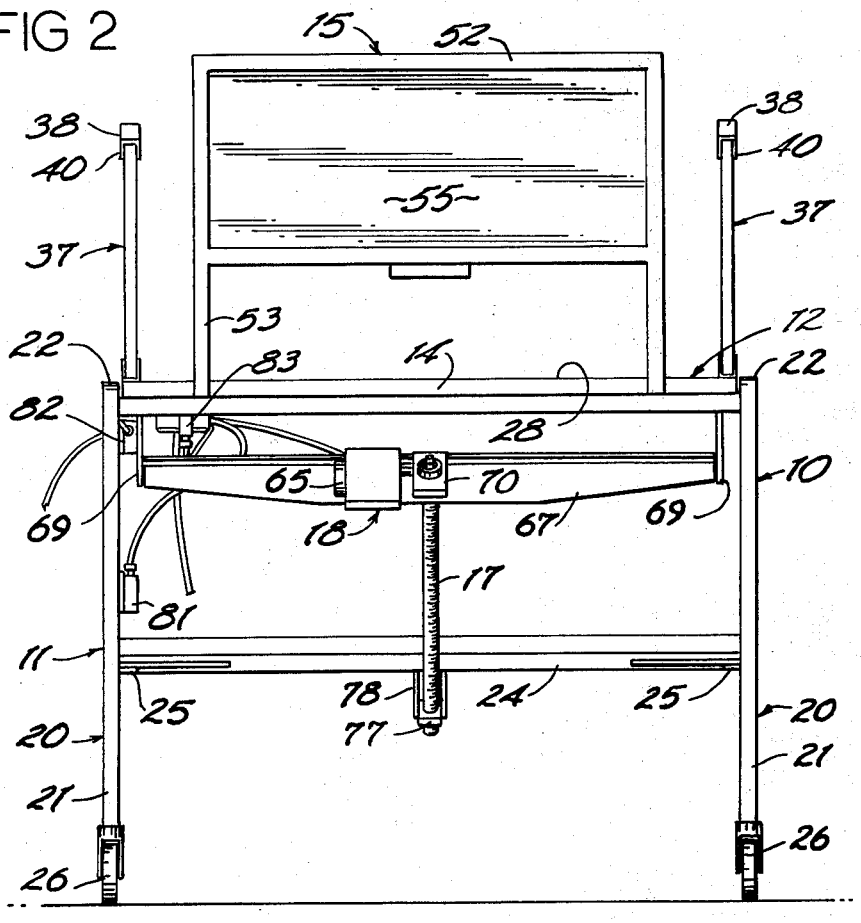
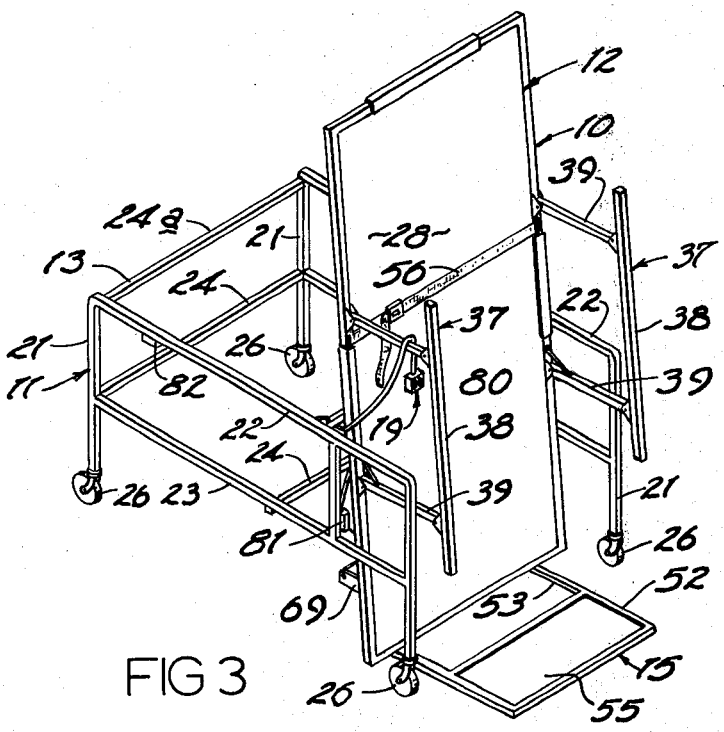
FIG 3

BED WITH AUTOMATIC TILTING OCCUPANT SUPPORT

BACKGROUND OF THE INVENTION

The present invention relates broadly to the field of beds and more particularly to beds having a tiltable occupant support platform.

It is not unusual that persons suffering from back injuries or recovering from different types of surgery are required to maintain their body in a single unchanging condition. Although the patient may be able to convalesce at home, he requires some assistance, especially when getting into and out of bed. It is found to be an extremely difficult task for a person whose body must remain rigidly in a straightened condition to raise or lower himself to or from a supine or prone lying position. Often, this cannot be accomplished without assistance from at least one other person. It has therefore become very desirable to obtain a bed that includes a tiltable occupant receiving platform that can be moved to raise and lower an occupant between an upright standing position and a horizontal supportive position. It is further desirable to obtain such a bed that offers easy access to the occupant and that requires minimum assistance from others.

A partial solution to the above problems is realized by U.S. Pat. No. 2,763,520 to Climo. Climo discloses a rollable and tiltable hospital bed. This bed includes a supportive framework that pivotably mounts a patient support platform. However, the framework completely surrounds the user so he cannot leave the bed, but must step or be lifted over a cross-frame member before he may get away from the bed.

U.S. Pat. No. 3,640,520 to Weiland et al discloses a therapy treatment tilt table. This is a somewhat complex apparatus that is designed for therapy treatment. An occupant support platform is provided above a base frame. The platform is pivoted at an end of the frame and moves from a horizontal position adjacent the flat top surface of the base to an upright position adjacent the face or upright front of the base. In the upright position, the platform is substantially perpendicular to the supportive floor plane. No peripheral framework is provided to assist the occupant in moving to and from the support platform. The platform is moved between the horizontal and upright positions by a motor and screw assembly held within the base. The motor is pivotably attached to the base with the screw extending therefrom to pivotably attach to the support platform.

SUMMARY OF THE INVENTION

A bed is described for raising and lowering an occupant between a first prone or supine lying position and a second upright standing position. The bed includes a longitudinal leg supported framework comprised of a laterally spaced pair of parallel upright side frames. The frames extend longitudinally along either side of the bed between a foot and head end. An occupant support platform also having a head and foot end is pivotably mounted between the side frames for movement thereon about a fixed horizontal axis. The platform is movable about the axis between a first horizontal position and a second upright position. The pivot axis is located between the foot and head ends of the side frames. A first abutment means is provided on the framework to prevent pivotal movement of the platform in one direction past the horizontal position. A second abutment means is located on the side frames for preventing pivotal movement of the platform in an opposite direction past the upright position wherein the platform is inclined toward the head end of the side frames. Cross members extend transversely across the framework to join the side frames together. These cross members are situated longitudinally between the horizontal pivot axis of the platform and the head ends of the side frames. An upright foot rest assembly is mounted to the support platform adjacent its foot end. The foot rest and the platform are pivoted about the horizontal axis through operation of a screw shaft that is rotatably journalled at one of its ends to a bracket pivotably mounted to the underside of the occupant support platform. The bracket is pivotal about a horizontal bracket pivot axis that is spaced toward the foot end from the platform pivot axis. A nut is mounted to the framework for movement about a fixed transverse axis. The nut threadably receives the remaining end of the screw shaft. A drive means is included for rotating the screw shaft and control means associated therewith may selectively actuate the drive means to move the occupant platform between the first and second positions.

It is a first object of the present invention to provide a bed whereby an occupant may be automatically moved from a lying position to a standing position without necessitating that his body be bent in any manner.

An additional object is to provide such a bed wherein the support platform and associated frame are so constructed to enable easy access by the occupant.

An additional object is to provide such a bed wherein the support platform will not raise to an upright position perpendicular with the floor but rather a position whereat the head end of the platform is inclined toward the head end of the bed frame. This provision enables partial support of the occupant while in the raised or standing position rather than moving to a position whereby the occupant must assume total support of his body as the platform reaches the upright position.

A still further object is to provide such a bed that includes a drive mechanism whereby the support platform will not drop or pivot freely from either operative position in the event of a power failure, motor breakdown, or other causes of operational failure.

A yet further object is to provide such a bed that is relatively simple in construction and inexpensive to manufacture.

A still further object is to provide such a bed that includes safety provisions for automatically operating or stopping the drive mechanism upon sensing unsafe operating conditions.

These and still further objects and advantages will become apparent upon reading the following description which, taken with the accompanying drawings, disclose a preferred form of the present invention.

BRIEF DESCRIPTION OF THE DRAWINGS

FIG. 2 is an end view of the bed as seen from the right in FIG. 1;

FIG. 3 is an isometric pictorial view of the bed showing the support platform in an upright position;

DETAILED DESCRIPTION OF A PREFERRED EMBODIMENT

Figure 1:
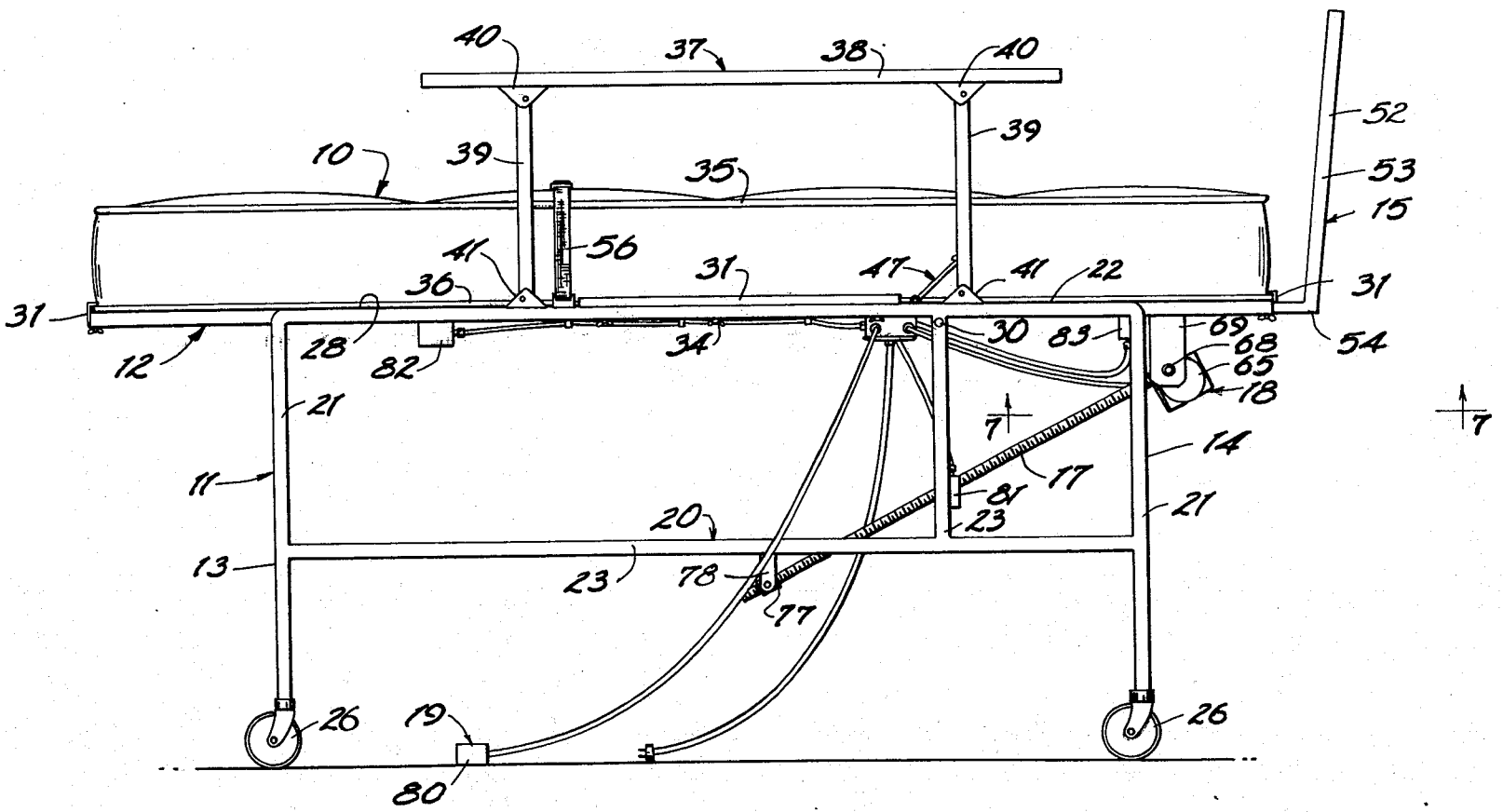
FIG. 1 is an orthographic side view of the present bed.
Figure 4:
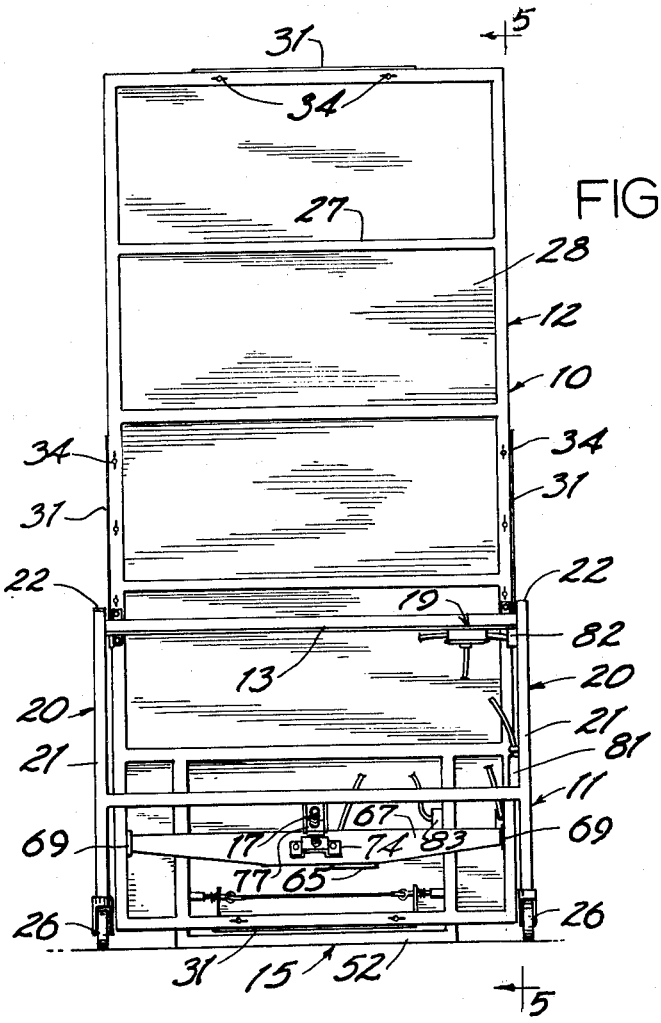
FIG. 4 is an end view of the bed in an upright position.

A preferred form of the present bed is illustrated in the accompanying drawings and is generally designated therein by the reference numeral 10. Basically, the bed includes a supportive framework 11 that pivotably mounts a support platform 12. A foot rest assembly 15 is mounted to platform 12 at a foot 14 of the bed. The platform 12 extends longitudinally from the foot rest assembly 15 to a head end 13 of the bed.

The support platform 12 is moved about its fixed horizontal pivot axis by rotation of a screw shaft 17 that is operated by a drive means 18. A control means 19 is also provided to enable selective operation of drive means 18 to raise and lower the support platform between a first horizontal position and a second upright position.

Figure 5:
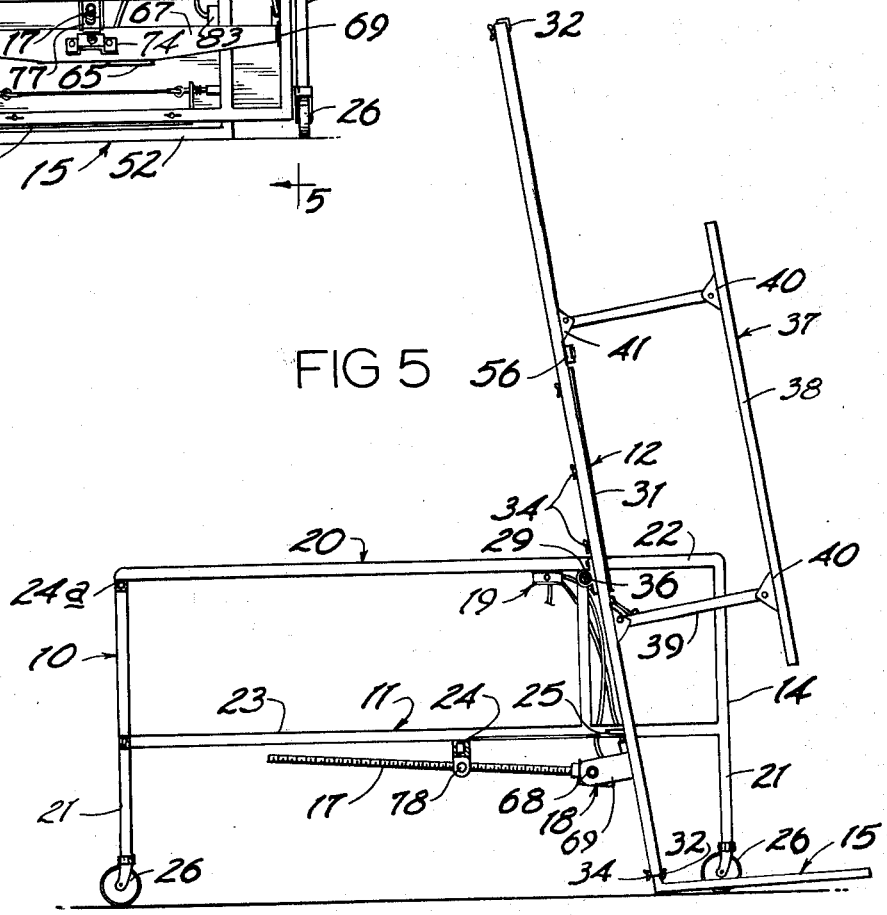
FIG. 5 is an enlarged sectional view taken along line 5—5 in FIG. 4.

Looking now in greater detail to supporting framework 11, particular reference will be made to FIG. 5. As shown, framework 11 is comprised of laterally spaced longitudinal side frames 20. Frames 20 are supported at longitudinal ends by upright legs 21. The legs 21 are connected longitudinally by horizontal rails 22 that are elevationally spaced from the supporting floor surface. An intermediate frame 23 is provided within each side frame 20 to provide rigidity to the framework without obstructing pivotal movement of the platform between the first and second positions. FIGS. 3 and 5 show a plurality of cross members 24 that extend laterally between the side frames 20.

These are located toward the head end 13 from the pivot axis of platform 12. The open frame at foot end 14 allows pivotal movement of the platform between the side frames 20 to its upright position. In this position the rails 22 serve as hand rails to aid the occupant in moving to and from the bed.

One cross member 24a functions as an abutment means to prevent pivotal movement of the support platform 12 past the first horizontal position. Second abutments 25 are provided on framework 11 in the pivotal path of platform 12. The second abutments 25 are utilized to prevent pivotal movement of the platform beyond the second upright position. It may be noted in FIGS. 3 and 5 that the upright position of platform 12 is not perpendicular to the plane of the floor surface. This is an important consideration and will be discussed in greater detail below.

The complete bed 10 is movably supported on a floor surface by a number of wheels 26 provided at the lower ends of legs 21. The wheels 26 may be equipped with locking mechanisms selectively operable to hold the bed at a stationary position while in operation. Such locks are conventional by nature and will not be discussed in great detail by this specification.

Figure 10:
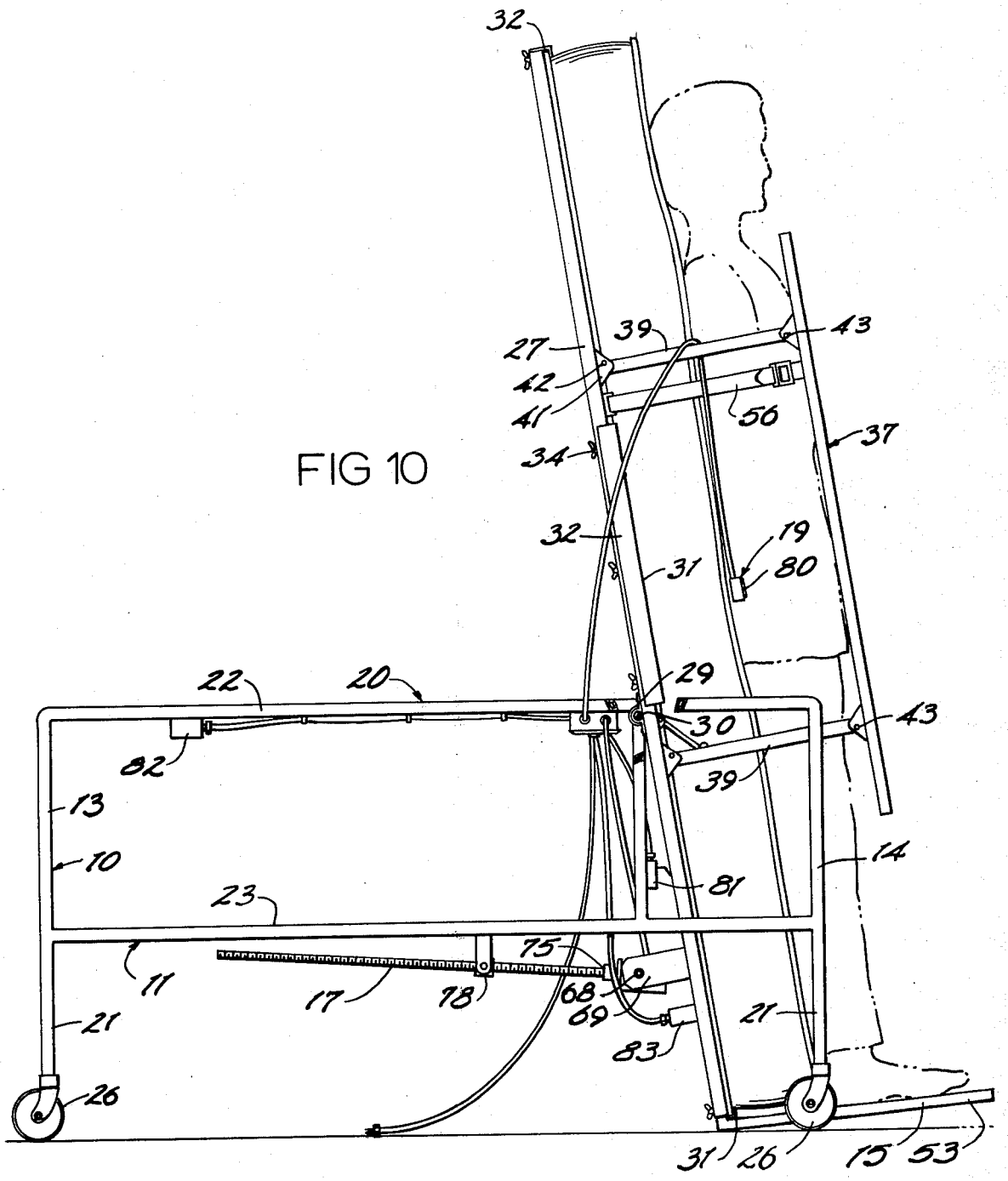
FIG. 10 is an enlarged side view of the bed with an occupant thereon shown by dotted lines.

Platform 12 includes a substantially rigid platform frame 27 with a planar support surface 28 mounted thereon. The platform, as briefly discussed above, is pivotably mounted to the framework 11. A transverse axle rod 30 is fixed to the frame 11 for this purpose. Also, mounted on platform frame 27 are a pair of bearings 29 that rotatably journal opposite ends of the transverse axle rod 30. Bearings 29 define a stationary pivot axis that is horizontal and transverse to the length of the bed 10. It is also important to note that the longitudinal position of the axis is intermediate the foot and head ends of the bed. The legs 21 are thereby located on both sides of the platform when in the upright position (FIG. 10). This serves to hold platform 12 against tipping along its length while presenting a portion of rails 22 as hand rails for use by the occupant, and leaving an unobstructed passage for the occupant to leave the bed.

A mattress 35 (FIGS. 1 and 10) may be secured to the planar support surface 28 by means of releasable clamps 31. The clamps 31 are formed of strap metal 32 about the periphery of support surface 28. The straps 32 include downwardly projecting studs (not shown) that are loosely received in upright apertures formed through the platform frame 27. Wing nuts 34 are provided to threadably engage studs 33 on the bottom sides of the frame 27 in order to pull the straps 32 downwardly against surface 28. A mattress bead 36 may be positioned between the straps 32 and surface 28 and clamped thereto by wing nuts 34. It is important that the mattress 35 remain in position on the support surface 28, otherwise, a loose mattress could fall dangerously from the support surface when held in the upright condition.

Figure 6:
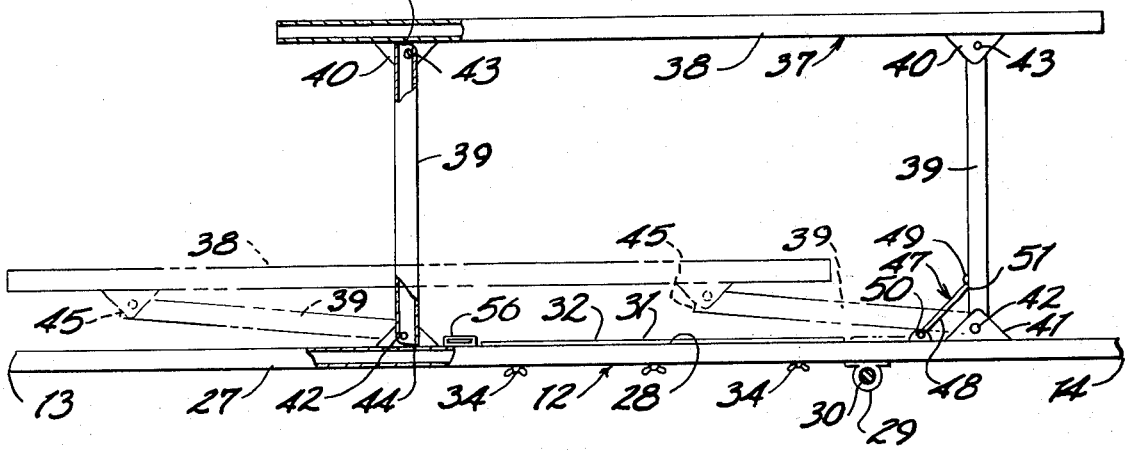
FIG. 6 is an enlarged fragmentary view illustrating the details and operation of a side guard rail assembly.

FIGS. 1, 3 and 10 show a side guard rail assembly 37. FIG. 3 shows one such assembly 37 on either longitudinal side of support platform 12. Guard rail assemblies 37 are mounted to the platform 12 and will therefore move along with the platform between upright side frames 20. FIG. 6 shows in detail the construction of one guard rail assembly 37. As shown, each assembly includes an upper horizontal guard rail 38. The rails 38 are supported at longitudinal ends by pivoted legs 39. A pair of brackets 40 are mounted to guard rails 38 for receiving upper ends of legs 39. Another pair of brackets 41 are mounted on platform 12 immediately below brackets 40. Brackets 41 receive lower ends of legs 39. Pivot pins 42 are provided that extend through brackets 40 and through the upper ends of legs 39. Likewise, pivot pins 43 are provided that extend through brackets 41 and the lower ends of legs 39.

It is important to notice the positions of the pins 42 and 43 in relation to the longitudinal centers of legs 39. The lower pivot pins 43 are oriented longitudinally toward the sides of legs 39 facing the head end 13 of the bed. Pivot pins 42 are situated close to the sides of legs 39 that face the foot of the bed.

Legs 39 include flattened abutment surfaces 44 and 45 (FIG. 6) at their opposite ends. Abutments 44 and 45, in association with the positioning of pins 42 and 43, serve to allow pivotal movement of the assemblies 37 only in a specific angular space. Abutment surfaces 44 and 45 come into contact with the platform frame and the guard rails 38 as the assemblies are moved to an upright operative position as shown by solid lines in FIG. 6.

A locking means 47 (FIG. 6) is provided to enable an assistant or the occupant to selectively lock the side guard rail assemblies 37 in an upward operative condition. Locking means 47 is simply comprised of latch bars 48 and catches 49. Latch bars 48 are mounted by pivot hinges 50 to the support platform 12. Each latch bar 48 includes an outwardly projecting end 51 that is loosely received by a catch 49. Catch 49 is fixed on one leg 39. In order to operate locking means 47, the side guard rail assemblies are first pivoted slightly beyond the upright operative positions. The latch bars 48 are then lifted or pivoted upwardly until their ends 51 come into engagement with catches 49. The tendency for the assemblies to move gravitationally back to the inoperative position serves to hold the catch bar in place.

A safety belt 56 (FIG. 3) is connected to platform 12 as a safety measure for holding the occupant against platform 12 (FIGS. 3 and 10) while moving between the two positions. Belt 56 is longitudinally located on platform 12 so it may engage and hold the occupant above the waist, therefore assuring that the occupant will not bend forwardly while moving between positions.

Figure 7:
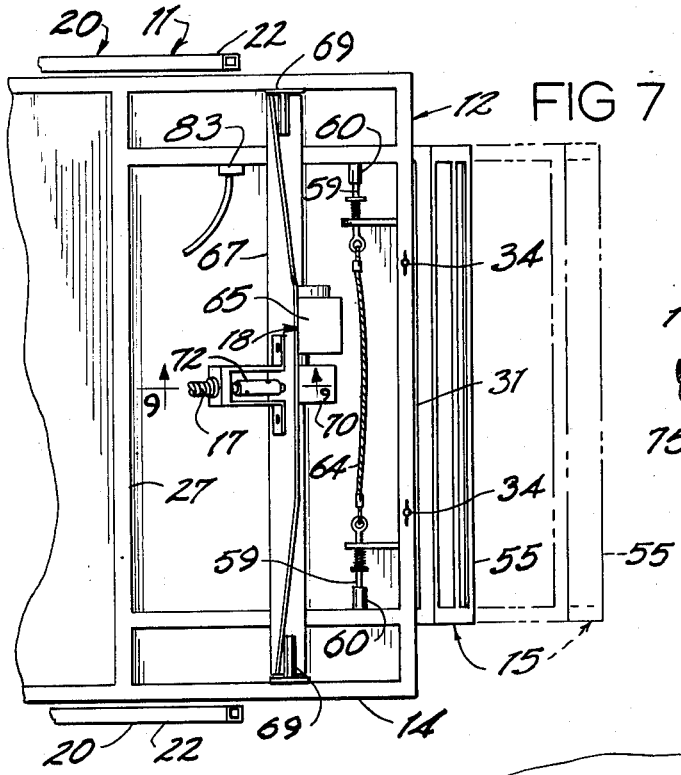
FIG. 7 is a sectional bottom plan view of a portion of the present bed as taken along line 7—7 in FIG. 1.

Foot rest assembly 15 is shown in particular detail by FIGS. 3, 5 and 7. Assembly 15 is basically L-shaped in configuration and includes a supportive framework 52. L-shaped framework 52 includes upright leg members 53 and horizontal legs 54. A planar support panel 55 is provided between the upright legs 53 as a support for receiving and bearing the weight of an occupant. The horizontal legs 54 of foot rest assembly 15 are slidably received within channels 57 formed in platform frame 27. Channels 57 enable longitudinal adjustment of the foot rest assembly 15 toward or away from an occupant resting on support platform 12.

Foot rest assembly 15 may be moved between an operative and inoperative position (shown by solid and dashed lines respectively in FIG. 7), through operation of a spring biased latch means 58. As shown in FIG. 7, and more particularly in FIG. 8, the latch means is comprised of a pair of pins 59 that are slidably held beneath the platform 12. The pins 59 are received within guide tubes 60 that project laterally inward from the receiving channels 57. Compression springs 61 are provided for each pin 59. Each spring 61 is mounted between a bracket 62 and a collar 63. The brackets 62 are fixed to the support platform 12, while collars 63 are fixed to pins 59. The springs therefore urge pins 59 continuously toward foot rest legs 54 within channels 57.

Figure 8:
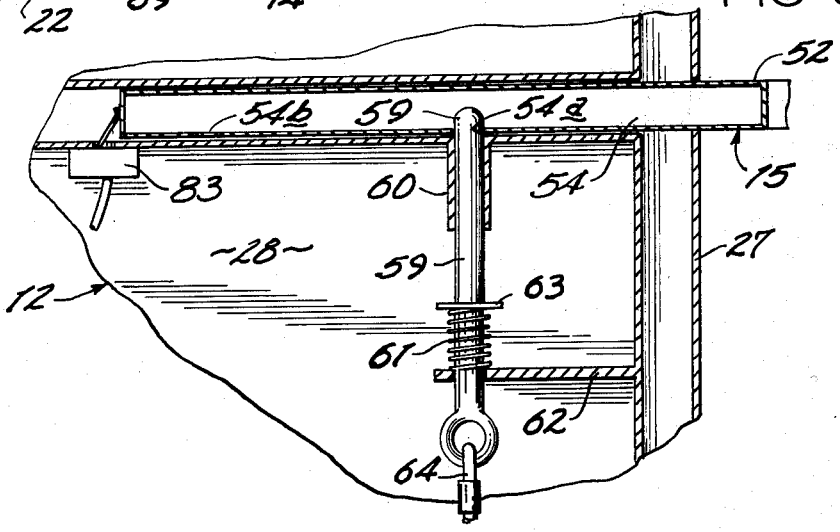
FIG. 8 is an enlarged sectional view of a foot rest lock mechanism.

A cord 64 extends between inside ends of pins 59. Cord 64 enables manual control of the latch means 58. In operation, the cord 64 may be pulled to slide the pins 59 away from engagement with complementary holes 54*a* in legs 54 (FIG. 8). Foot rest assembly 15 is then free to be pulled or pushed longitudinally relative to platform 12. Cord 64 may be released as the foot rest reaches an extended inoperative position to allow pins 59 to snap into another appropriately aligned set of apertures 54*b* formed through legs 54. Further details concerning the function of this portion of my invention will become more fully understood later in this specification.

Figure 9:
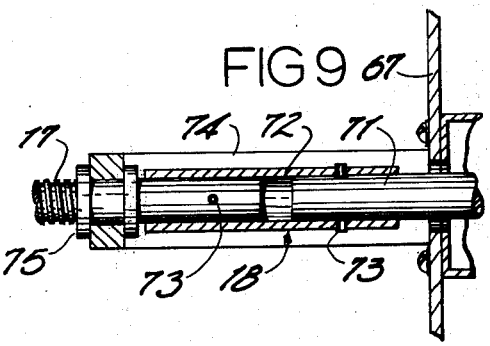
FIG. 9 is an enlarged sectional view taken along line 9—9 in FIG. 7.

FIGS. 7 and 9 more specifically illustrate the features of the drive means 18 utilized to move platform 12 between the first and second positions. The drive means includes a motor 65 that is operatively connected to screw shaft 17. Motor 65 is mounted to a bracket member 67 beneath support platform 12. The bracket member 67 is pivotably mounted to platform 12 by depending ears 69 that are affixed on opposite longitudinal sides of the platform adjacent its foot end 14. The ears include pivot pins 68 that protrude inwardly to be received by hinge members at opposite ends of the bracket member 67. Pins 68 define a horizontal bracket pivot axis that is parallel to the pivotal axis of platform 12. They allow pivotal movement of motor 65 in response to movement of platform 12 between the first and second positions.

The screw shaft 17 is connected at one end to a gearbox 70 (FIG. 7) that is driven by motor 65. A stub drive shaft 71 (FIG. 9) extends outwardly from gearbox 70. A sleeve 72 receives shaft 71 and is attached thereto by a pin 73. An end of screw shaft 17 is also received within the sleeve 72 and is connected thereto by another pin 73. As an added safety precaution, a thrust bearing 75 is provided to connect the screw shaft with the cross member 67. A U-shaped bracket 74 locates the thrust bearing 75 beyond sleeve 72 from motor 65 (FIG. 9). Thrust bearing 75 is utilized as a safety precaution to transfer loads from screw shaft 17 to bracket member 67, bypassing the gearbox 70.

A threaded nut 77 (FIG. 2) receives the remaining end of screw shaft 17. Nut 77 is mounted by a pivot bracket 78 to a cross member 24 of framework 11. The nut 77 is free to pivot about a horizontal axis parallel to and longitudinally spaced from the pivot axis of bracket member 67. As the screw shaft 17 is turned, nut 77 and bracket member 67 are drawn together or forced apart, resulting in corresponding pivotal movement of support platform 12.

Should motor 65 fail while in operation, platform 12 will remain in the same position it had reached when the motor failed. This is true because the screw shaft 17 will not turn in response to longitudinal (axial) force applied thereto. Only rotational movement of screw 17 about its axis will result in pivotal movement of the platform. Should such a condition occur, provisions are made through gearbox 70 to enable manual rotation of screw shaft 17, to move platform 12 between the two positions.

A control box 80 (FIGS. 1 and 3) is provided that may be utilized either by the occupant or by an assistant. Box 80 includes directional controls for actuating motor 65 to raise or lower the platform.

To insure safe operation, a number of limit switches are utilized that override the function of control box 80. Firstly, a limit switch 81 is positioned on framework 11 adjacent abutment 25. Limit switch 81 is actuated as platform 12 reaches the upright position. In this position, the switch 81 overrides control of button 80 to deactivate motor 65. Switch 81 thereby prevents possible damage that would be done if the motor could continue to operate after platform 12 reached abutments 25.

A second limit switch 82 is provided on framework 11 adjacent to platform 12 when located in the horizontal position. Switch 82 is operated as platform 12 reaches this position to override control box 80. Switch 82, then, deactivates motor 65 when the platform reaches the first horizontal position.

A third limit switch 83 is provided to prevent operation of the bed unless foot rest assembly 15 is held at an inner operative position (solid lines, FIG. 7). This switch, as seen in FIG. 7, is located on the lower side of platform 12 and is operated by horizontal legs 54. Switch 83 closes the control circuit once the legs 54 move inwardly to the operative position as shown in FIG. 7. If the foot rest assembly is located in an inoperative position (dashed lines, FIG. 7), limit switch 83 holds the control circuit open to prevent anyone from operating the bed through control box 80. This is an important safety feature. If the foot rest assembly is not in the operative position, a patient could easily be injured when the platform reaches an upright position. An occupant's feet would not normally be in contact with surface 55 when the foot rest is at an inoperative position. However, in the operative foot rest position, the patient's feet are in contact with or closely adjacent to surface 55 so his weight will be received gradually by foot rest assembly 15 as platform 12 is pivoted upwardly.

Damage to the bed or to the floor surface could result if the foot rest were to remain in an outer inoperative position. In this position the foot rest is located at a radial distance from the horizontal platform pivot axis that is greater than the distance from the pivot axis to the floor.

From the above technical description, a more thorough understanding of the operation of the present invention may now be had.

To begin with, we assume the bed to be in a normal position with platform 12 situated in the first horizontal position and with the foot rest in an operative position. In order to occupy the bed, a user or an assistant operates control box 80 to pivot platform 12 to the upright position. Limit switch 81 automatically deactivates motor 65 once the support platform 12 reaches this condition.

The platform is slightly inclined in the upright occupant receiving position (FIG. 10) with its head end inclined toward the head end of framework 11. This allows the occupant to step onto foot rest 15 and partially distribute his weight against the platform 12 while remaining in a substantially upright position. The occupant may assume the position (prone or supine) he wishes to arrive at when the platform is pivoted to the horizontal position. Once the occupant is situated with his weight supported on foot rest 15 and platform 12, he or an assistant may secure safety belt 56 about his upper torso. Control box 80 may then be operated to pivot platform 12 to the horizontal position.

Limit switch 82 is actuated upon reaching the horizontal position to deactivate motor 65 and stop further pivotal movement of the platform. This occurs as the head end of platform 12 comes into contact with abutment cross member 24a.

When the occupant is located in the horizontal position, an assistant may disengage the foot rest assembly 15, allowing the occupant's feet to move from contact with the support surface 55. This is accomplished by pulling against the cord 64 in a longitudinal direction. Pins 59 are thereby retracted from holes **54*a*. The foot rest assembly is then free to move longitudinally within the receiving channels 57. Thus when the pins are disengaged, the assistant may pull the foot rest assembly longitudinally away from the patient's feet. As the assembly approaches an inoperative extended position, holes 54*b* become aligned with the pins 59. Springs 51 snap the pins 59 into the aligned apertures 54*a* locking the foot rest assembly in place at the inoperative position. In this position, the limit switch 83 opens the circuit through box 80** to prevent accidental actuation of the motor while the foot rest is in the extended position.

To move an occupant resting on the support platform to an upright position, the first step is to secure the safety belt about the occupant's upper torso. Next, the occupant or an assistant may pivot the side guard rail assemblies 37 into their upright operative positions. Latch bars 48 are lifted to engage the catches 49 in order that the guard rail assemblies be locked in the upright operative positions. Next, the foot rest is moved into an operative position by first removing the pins 59 from the associated holes **54*b* and gently pushing the panel surface 55 longitudinally toward the occupant's feet. Once the occupant's feet are engaged by panel 55, and pins 59 are positioned in holes 54*a*** to lock the foot rest assembly in the retracted operative position, the occupant or assistant may actuate the drive means to raise the platform to the upright position.

To remove himself from bed, the occupant or assistant first disengages the safety belt 50. The occupant may, when he feels sure of his balance and strength, utilize guard rails 38 or rails 22 of framework 11 as support while he moves away from the bed. The open framework at foot end 14 allows free unobstructed movement of the occupant to or from the bed.

It should be noted that the occupant is positioned in the upright location of the support platform with a portion of his weight received by the inclined platform. Therefore, he must pull himself slightly forward utilizing the guard rail assemblies 37 before he becomes totally supported by the foot rest assembly 15. The inclination of the platform allows the occupant to wait until he is confident that he is capable of fully supporting and balancing himself before his total body weight is shifted to his feet. Further, should the occupant faint or pass out when arriving at the upright position, this inclination of the platform serves to naturally hold the occupant from bending over the safety strap.

It should be noted that the above description and attached drawings are given only to disclose a single preferred form of the present invention. Only the following claims are to be taken as limitations upon the scope of my invention.

What I claim is:

1. A bed for raising and lowering an occupant between a prone or supine position and an upright standing position, comprising:

an elongated leg supported framework having a pair of laterally spaced parallel upright side frames extending longitudinally from a foot end to a head end thereof;

longitudinal horizontal side frame rails extending from head to foot ends of the side frames;

a flat rigid occupant support platform pivotably mounted between the side frame rails for pivotal movement about a horizontal platform pivot axis between a horizontal position and an upright position;

wherein said horizontal platform pivot axis is located longitudinally intermediate the foot and head ends of the framework such that the rails of said side frames may be utilized as hand rails when the platform is in the upright position;

first abutment means for preventing pivotal movement of the platform in one direction past the horizontal position;

second abutment means on the side frames for preventing pivotal movement of the platform in an opposite direction past the upright position;

cross members extending transversely across the framework to join the side frames together, said cross members being located at longitudinal positions on the framework between the horizontal pivot axis and the head end of the framework so as not to obstruct access to the platform when in the upright position;

a foot rest assembly mounted to the support platform assembly adjacent the foot end;

a bracket mounted to an underside of the occupant support platform for pivotal movement about a fixed horizontal bracket pivot axis spaced toward the foot end from the platform pivot axis;

a screw shaft;

a nut mounted to the framework for pivotal movement about a fixed transverse axis and threadably receiving one end of the screw shaft;

drive means on the bracket receiving the remaining end of the screw shaft and for rotating the screw shaft; and control means for selectively actuating the drive means to move the occupant platform between the horizontal and upright positions.

2. The bed as recited by claim 1 further including a pair of side guard rail assemblies, each mounted on a longitudinal side of the platform and each comprising:

an elongated longitudinal guard railing;

a pair of parallel support legs of equal length and each having an end pivotably mounted to the platform with a remaining end pivotably mounted to the guard rail;

wherein the pivot axes of the support legs are parallel to one another and transverse to the longitudinal side frames;

stop means for preventing pivotal movement of the legs in a prescribed direction past a substantially perpendicular relationship with the platform surface; and locking means for selectively securing the legs and guard railing in an upright operative position wherein the legs are oriented substantially perpendicular to the platform.

3. The bed as recited by claim 2 wherein the stop means is comprised of:

a first pair of brackets on the platform each for receiving a lower end of one support leg of each pair;

first pivot pins extending through the first brackets and associated legs and disposed within the legs toward the head end of the bed with respect to the longitudinal center lines of the associated legs;

a second set of brackets on an underside of the guard railing for receiving upper ends of the support legs mounted to the first pair of brackets;

second pivot pins parallel to the first pivot pins and extending through the second brackets and upper leg ends and disposed within the upper leg ends toward the foot end of the bed with respect to the longitudinal center lines of the associated legs; and abutment surfaces on the upper and lower associated leg ends offset from the first and second pivot pins to be pivoted about the axes of the pins into contact with the platform and guard rail.

4. The bed as recited by claim 3 wherein the locking means is comprised of:

elongated latch bars mounted at one end to the platform for pivotal movement about axes parallel to the axes of the first and second pivot points and located toward the head end of the bed from one support leg of each pair;

a stationary catch member on the support legs adjacent the latch bars for engaging remaining ends of the latch bars when the legs and guard rails are in the upright operative position.

5. The bed as recited by claim 1 wherein the foot rest assembly comprises:

an L-shaped foot rest framework at the foot end of the platform including a foot engaging member and a longitudinal member protruding from the foot engaging member with the longitudinal member being held for longitudinal sliding movement along the occupant support platform; and a spring biased latch means mounted to the support platform for operative engagement with longitudinal member to selectively lock the foot rest at an extended inoperative position wherein the foot engaging member is spaced longitudinally from the foot end of the platform, or a retracted position wherein the foot engaging member is located longitudinally adjacent the foot end of the platform.

6. The bed as recited by claim 5 wherein the control means includes a safety switch mounted to the platform adjacent the foot rest for affecting operation of the drive means in response to the position of the foot rest assembly so when the foot rest assembly is in the extended position the drive means will not operate.

7. The bed as recited by claim 1 further comprising means for releasably securing a mattress to the support platform.

8. A bed for raising and lowering an occupant between a prone or supine position and an upright standing position, comprising:

an elongated leg supported framework having a pair of laterally spaced parallel upright side frames extending longitudinally from a foot end to a head end thereof;

longitudinal horizontal rails on the side frames extending from head to foot ends of the side frames;

a flat rigid occupant support platform pivotally mounted between the side frame rails for pivotal movement about a horizontal platform pivot axis between a horizontal position and an upright position;

wherein said horizontal platform pivot axis is located longitudinally intermediate the foot and head ends of the framework such that the horizontal rails of said side frames may be utilized as hand rails when the platform is in the upright position;

cross members extending transversely across the framework to join the side frames together, said cross members being located at a longitudinal position on the frames between the horizontal pivot axis and the head end of the framework so as not to obstruct access to the platform when in the upright position;

a foot rest assembly mounted to the support platform assembly adjacent the foot end thereof;

a screw shaft;

a nut mounted to the framework for pivotal movement about a fixed transverse axis and threadably receiving one end of the screw shaft;

drive means interconnecting the screw shaft and platform for rotating the screw shaft;

control means for selectively actuating the drive means to move the occupant platform between the horizontal and upright positions;

wherein the foot rest assembly includes an L-shaped foot rest framework at the foot end of the platform that includes a foot engaging member and a longitudinal member protruding from the foot engaging member with the longitudinal member being held for longitudinal sliding movement along the occupant support platform;

latch means for selectively locking the foot rest at an extended inoperative position wherein the foot engaging member is spaced longitudinally from the foot end of the platform, or a retracted position wherein the foot engaging member is located longitudinally adjacent the foot end of the platform; and wherein the control means includes a safety switch means for effecting operation of the drive means in response to the position of the foot rest assembly so when the foot rest assembly is in the extended position, the drive means will not operate.

* * * * *